US009371747B2

(12) United States Patent
Kandolf et al.

(10) Patent No.: US 9,371,747 B2
(45) Date of Patent: Jun. 21, 2016

(54) DUAL INDEPENDENT PHASER WITH DUAL-SIDED LOCKING COVER

(71) Applicant: Schaeffler Technologies GmbH & Co. KG, Herzogenaurach (DE)

(72) Inventors: Michael Kandolf, Saint Clair, MI (US); Roger Meyer, Brighton, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 101 days.

(21) Appl. No.: 14/451,862

(22) Filed: Aug. 5, 2014

(65) Prior Publication Data

US 2015/0040716 A1 Feb. 12, 2015

Related U.S. Application Data

(60) Provisional application No. 61/864,928, filed on Aug. 12, 2013.

(51) Int. Cl.
*F01L 1/34* (2006.01)
*F01L 1/344* (2006.01)

(52) U.S. Cl.
CPC ..... *F01L 1/3442* (2013.01); *F01L 2001/34453* (2013.01); *F01L 2001/34493* (2013.01); *Y10T 29/49293* (2015.01); *Y10T 74/2102* (2015.01)

(58) Field of Classification Search
CPC ..... F01L 1/3442; F01L 2001/3453; F01L 2001/34493
USPC ..... 123/90.15, 90.17
See application file for complete search history.

(56) References Cited

U.S. PATENT DOCUMENTS 7,841,311 B2 11/2010 Hutcheson et al.
8,051,818 B2 11/2011 Myers et al.
8,534,246 B2 * 9/2013 Lichti ..... F01L 1/3442 123/90.15

* cited by examiner

*Primary Examiner* — Ching Chang
(74) *Attorney, Agent, or Firm* — Simpson & Simpson, PLLC

(57) ABSTRACT

A dual independent phaser, including: one only single locking cover; a first phaser section including a first stator, a first rotor, a first plurality of chambers formed by a first rotor and the first stator, and first locking pin non-rotatably engaged with the first rotor and axially displaceable to non-rotatably connect the first rotor and the one only single locking cover; and second phaser section including second stator, a second rotor, a second plurality of chambers formed by a second rotor and the second stator, and second locking pin non-rotatably engaged with the second rotor and axially displaceable to non-rotatably connect the second rotor and the one only single locking cover.

20 Claims, 7 Drawing Sheets

DUAL INDEPENDENT PHASER WITH DUAL-SIDED LOCKING COVER

CROSS-REFERENCE TO RELATED APPLICATIONS

This application claims the benefit under 35 U.S.C. §119 (e) of U.S. Provisional Patent Application No. 61/864,928, filed Aug. 12, 2013, which application is incorporated herein by reference in its entirety.

TECHNICAL FIELD

The present disclosure relates to a dual independent phaser with a single dual-sided locking cover for use in locking respective rotors for the two phasing sections in the phaser

BACKGROUND

For a dual independent phaser, undesirable oscillation and vibration can occur while the chambers for the two phaser sections are filled with oil, for example, when an engine to which the phaser is connected, is started up. To prevent the oscillation and vibration while the chambers are filling, it is known to lock the respective rotors for each of the two phaser sections to respective separate locking covers using respective locking pins. Thus, it is known to use two locking covers in a dual independent phaser. However, the use of two locking covers increases the cost, complexity, and axial space requirements of the phaser.

SUMMARY

According to aspects illustrated herein, there is provided a dual independent phaser, including: one only single locking cover; a first phaser section including a first stator, a first rotor, a first plurality of chambers formed by a first rotor and the first stator, and first locking pin non-rotatably engaged with the first rotor and axially displaceable to non-rotatably connect the first rotor and the one only single locking cover; and second phaser section including second stator, a second rotor, a second plurality of chambers formed by a second rotor and the second stator, and second locking pin non-rotatably engaged with the second rotor and axially displaceable to non-rotatably connect the second rotor and the one only single locking cover.

According to aspects illustrated herein, there is provided a dual independent phaser, including: one only single locking cover; a first phaser section disposed on a first axial side of the one only single locking cover and including a drive sprocket arranged to receive torque from an engine, a first stator non-rotatably connected to the drive sprocket, a first rotor, a first plurality of chambers formed by a first rotor and the first stator, and a first locking pin non-rotatably engaged with the first rotor and axially displaceable to non-rotatably connect the first rotor and the one only single locking cover; a second phaser section disposed on a second axial side, axially opposite the first axial side of the one only single locking cover and including a second stator non-rotatably connected to the drive sprocket, a second rotor, a second plurality of chambers formed by a second rotor and the second stator, and a second locking pin non-rotatably engaged with the second rotor and axially displaceable to non-rotatably connect the second rotor and the one only single locking cover; and a drive sprocket non-rotatably connected to the first and second stators and arranged to receive torque from an engine. The first plurality of chambers is arranged to circumferentially position, in response to fluid pressure in the first plurality of chambers, the first rotor with respect to the drive sprocket. The second plurality of chambers is arranged to circumferentially position, in response to fluid pressure in the second plurality of chambers, the second rotor with respect to the drive sprocket.

According to aspects illustrated herein, there is provided a method of fabricating a dual independent phaser, including: non-rotatably connecting a drive sprocket and a first stator for a first phaser section to a first axial side of one only single locking cover; forming a first plurality of chambers with the first stator and a first rotor; non-rotatably engaging a first locking pin with the first rotor so that the first locking pin is axially displaceable to non-rotatably connect the first rotor to the one only single locking cover; non-rotatably connecting second stator for a second phaser section to a second axial side, axially opposite the first axial side, of the one only single locking cover; forming a second plurality of chambers with the second stator and a second rotor; non-rotatably engaging a second locking pin with the second rotor so that the second locking pin is axially displaceable to non-rotatably connect the second rotor to the one only single locking cover. The first plurality of chambers is arranged to circumferentially position, in response to fluid pressure in the first plurality of chambers, the first rotor with respect to the drive sprocket. The second plurality of chambers is arranged to circumferentially position, in response to fluid pressure in the second plurality of chambers, the second rotor with respect to the drive sprocket.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1A:
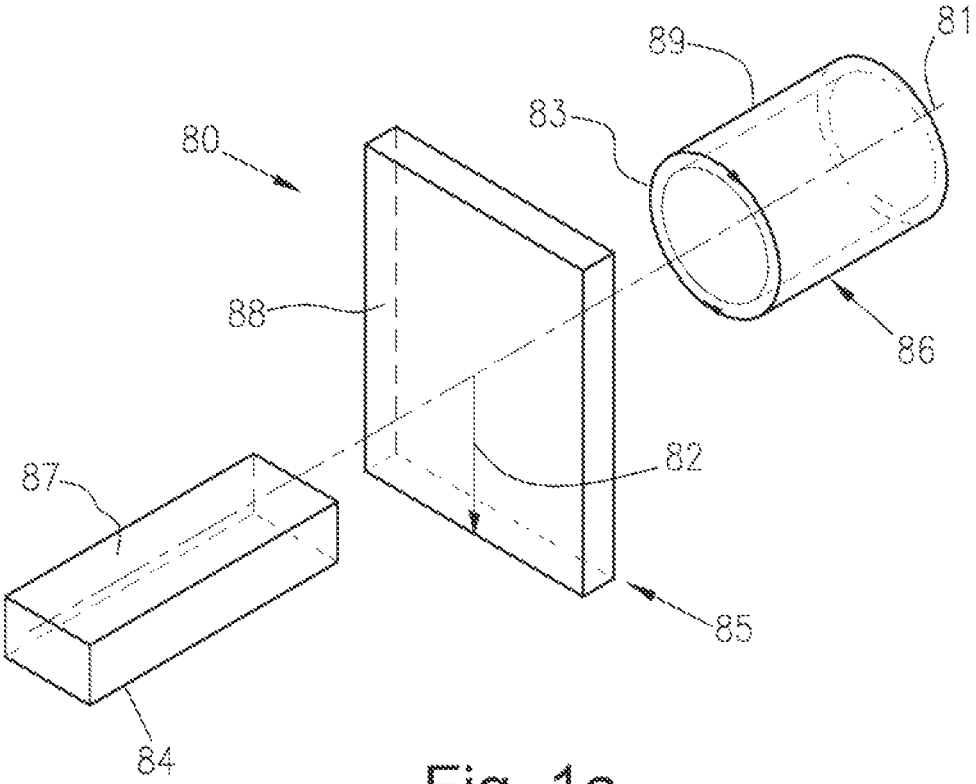
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present disclosure is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
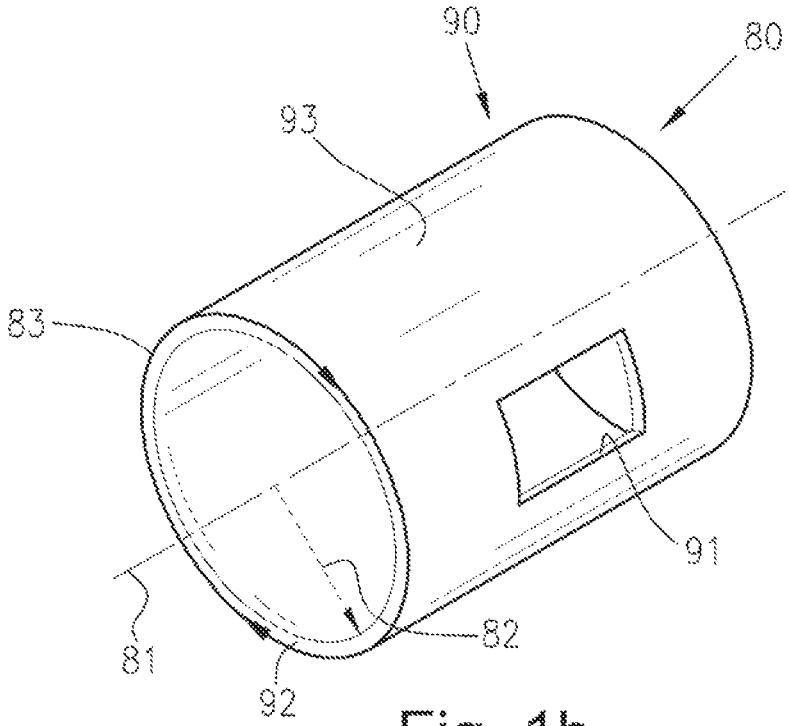
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
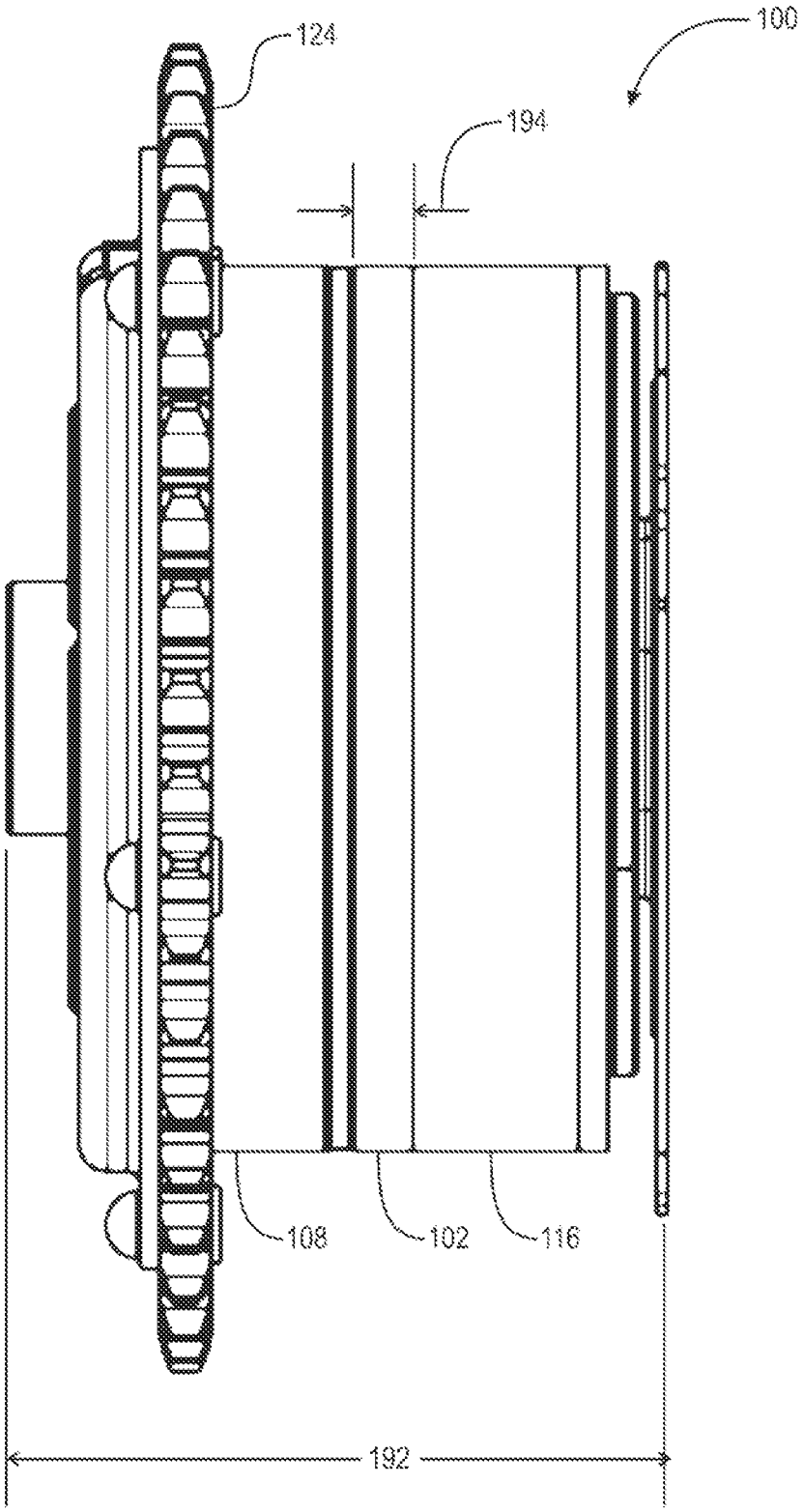
FIG. 2 is a side view of a dual independent phaser with a single locking cover.

FIG. 2 is a side view of dual independent phaser 100 with a single locking cover.

Figure 3:
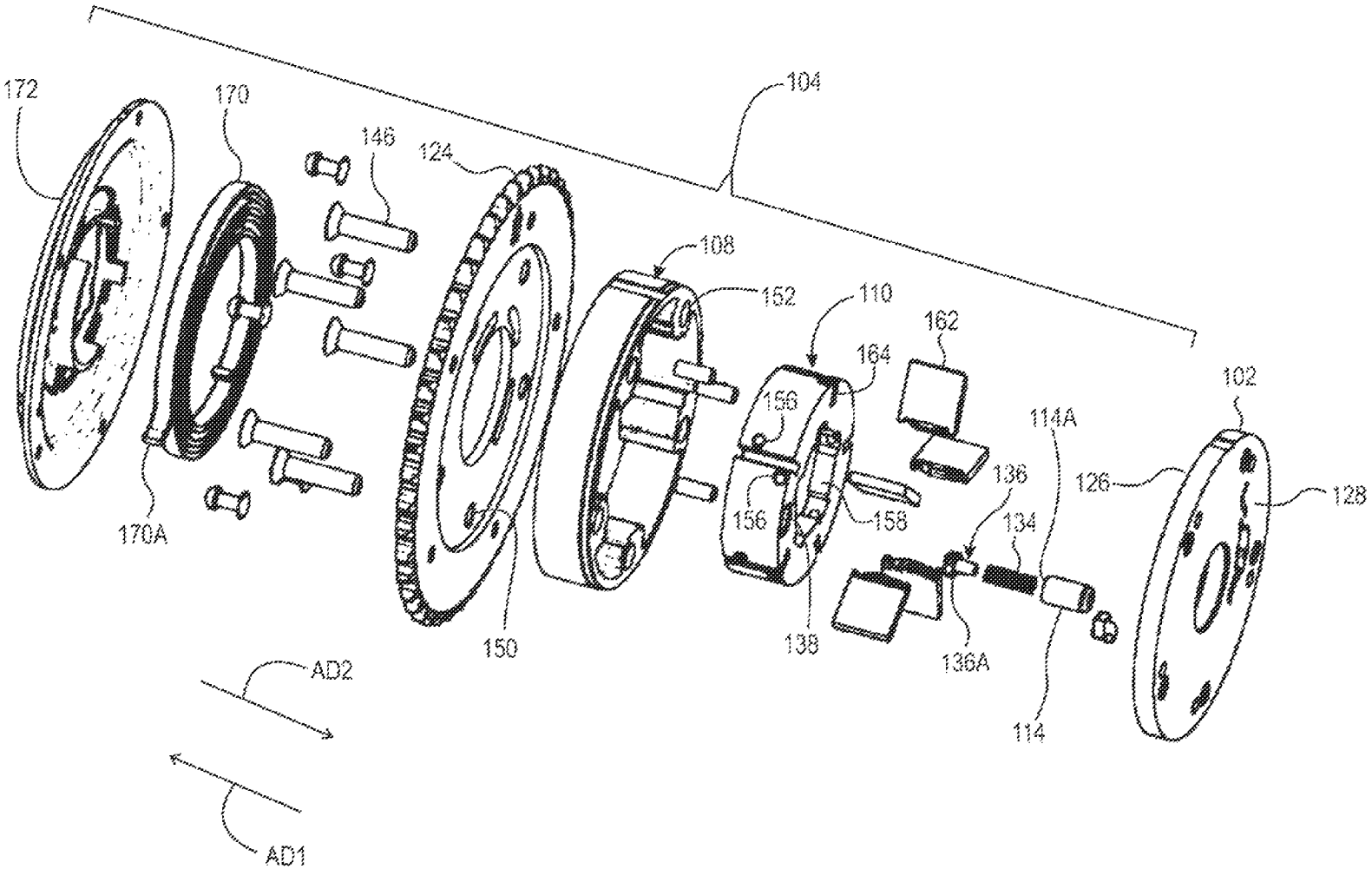
FIG. 3 is an exploded view showing one phaser section from the dual independent phaser of FIG. 2.

FIG. 3 is an exploded view showing one phaser section from dual independent phaser 100 of FIG. 2.

Figure 4:
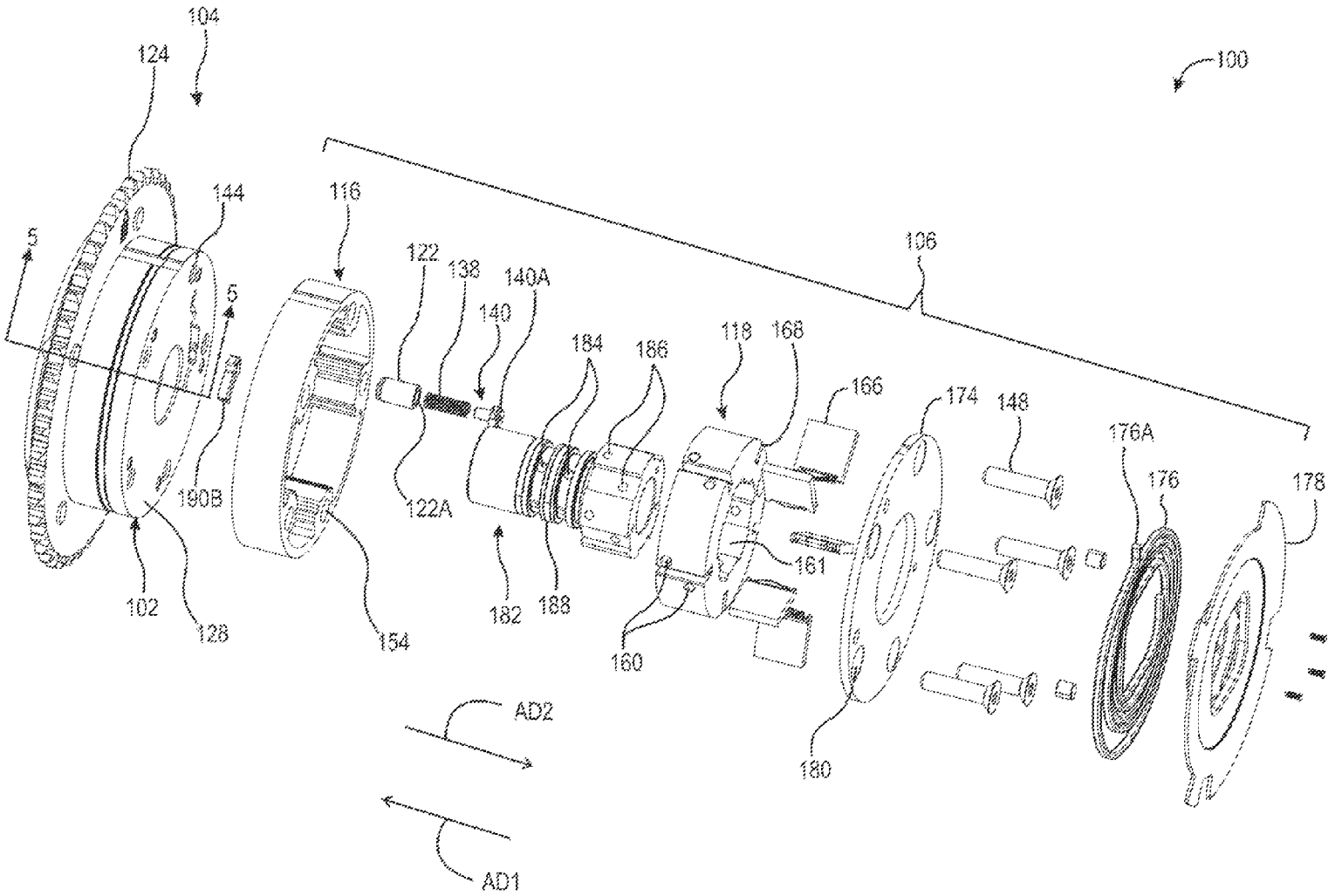
FIG. 4 is an exploded view of another phaser section of the dual independent phaser of FIG. 2 and shows the phaser section of FIG. 3 assembled.

FIG. 4 is an exploded view of another phaser section of dual independent phaser 100 of FIG. 2 and shows the phaser section of FIG. 3 assembled.

Figure 5:
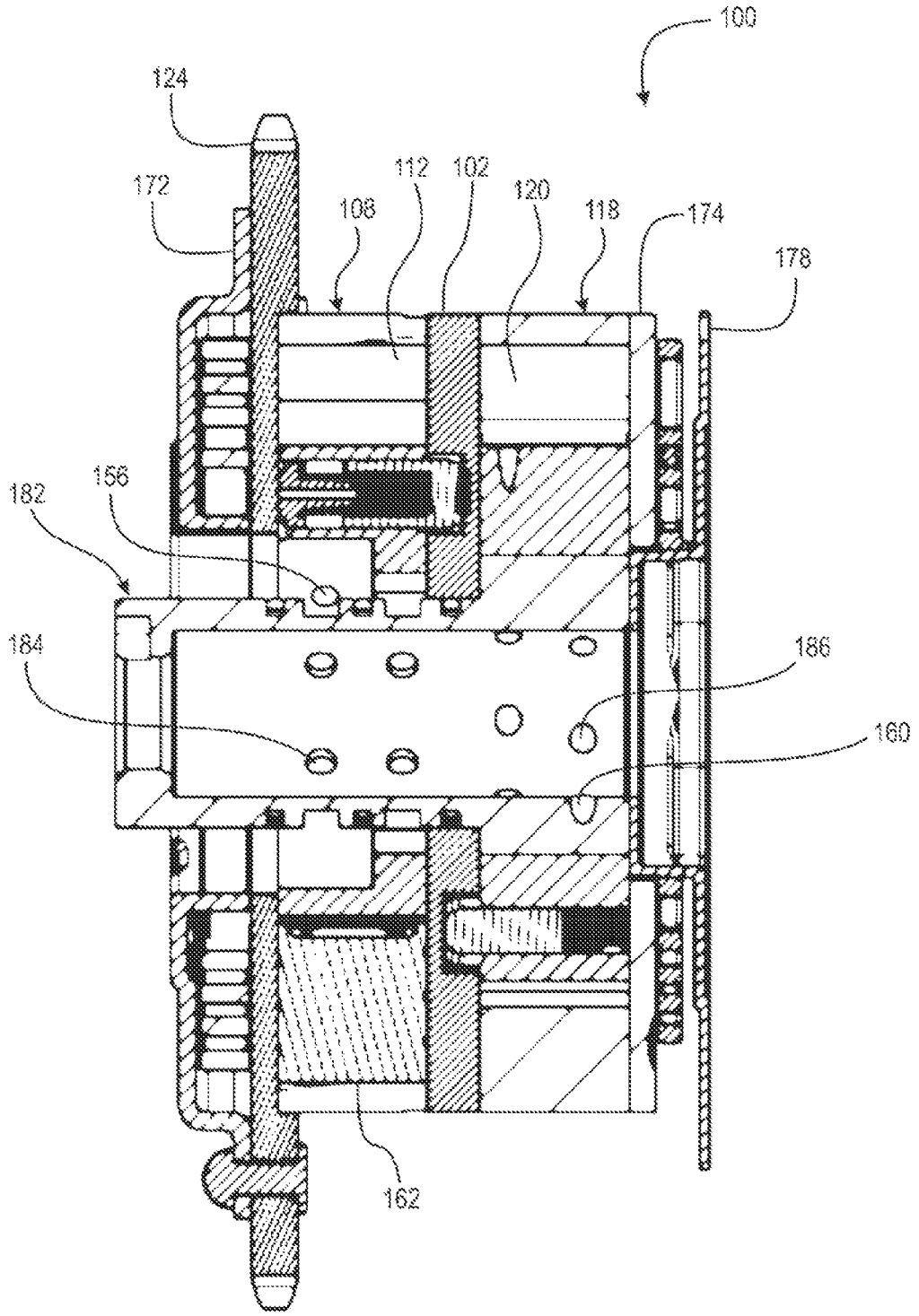
FIG. 5 is a cross-sectional view generally along line 5-5 in FIG. 4.

FIG. 5 is a cross-sectional view generally along line 5-5 in FIG. 4. The following should be viewed in light of FIGS. 2 through 5. Dual independent phaser 100 includes single locking cover 102, phaser section 104, and phaser section 106. Section 104 includes stator 108, rotor 110, chambers 112 formed by rotor 110 and stator 108, and locking pin 114 non-rotatably engaged with rotor 110 and axially displaceable to non-rotatably connect rotor 110 and locking cover 102.

Section 106 includes stator 116, rotor 118, chambers 120 formed by rotor 118 and stator 116, locking pin 122 non-rotatably engaged with rotor 118 and axially displaceable to non-rotatably connect rotor 118 and locking cover 102. In an example embodiment, phaser 100 includes drive sprocket 124 non-rotatably connected to stators 108 and 116 and arranged to receive torque from an engine.

Chambers 112 are arranged to circumferentially position, in response to fluid pressure in chambers 112, rotor 110 with respect to the drive sprocket. Chambers 120 are arranged to circumferentially position, in response to fluid pressure in chambers 120, rotor 118 with respect to the drive sprocket. Section 104 is disposed on axial side 126 of locking cover 102, and section 106 is disposed on axial side 128, axially opposite axial side 126, of locking cover 102.

Figure 6A:
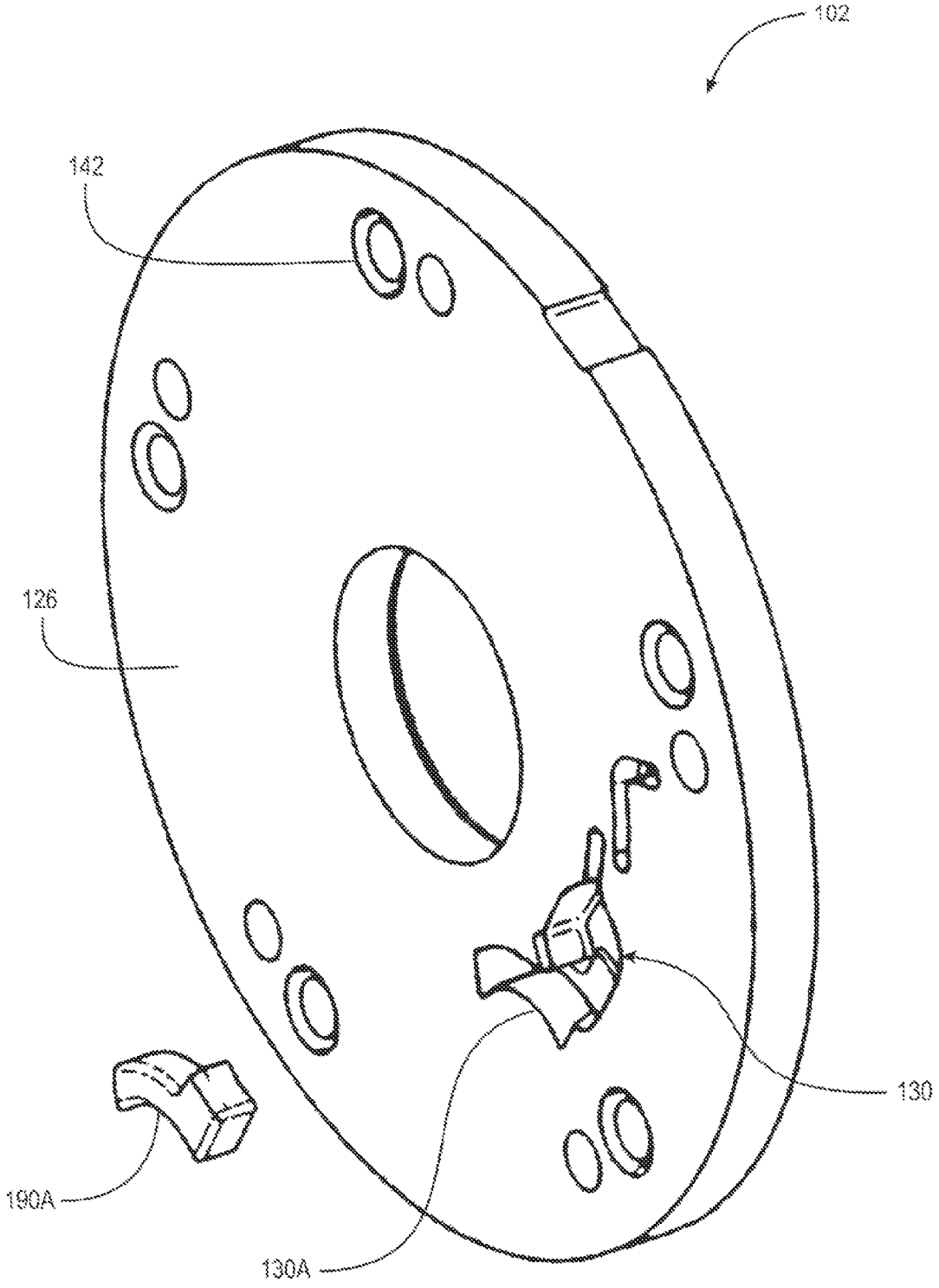
FIG. 6A is a perspective view of the single locking cover as seen from one side; and, FIG. 6B is a perspective view of the single locking cover as seen from another side.

FIG. 6A is a perspective view of locking cover 104 as seen from one side, for example, for the side of section 104.

Figure 6B:
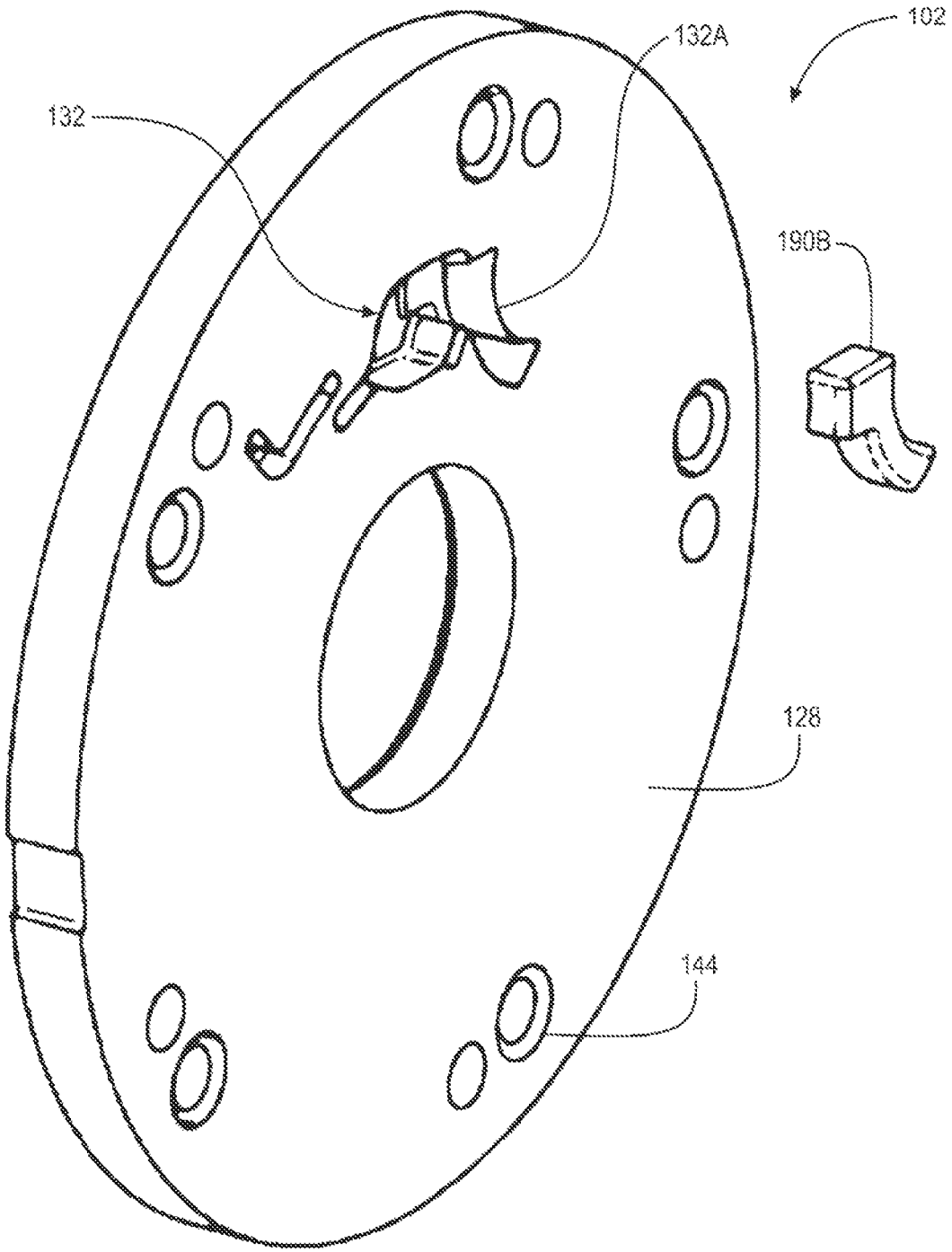

FIG. 6B is a perspective view of locking cover 104 as seen from another side, for example, for the side of section 106. The following should be viewed in light of FIGS. 2 through 6B. Locking cover 102 includes slots 130 and 132 in sides 126 and 128, respectively. Slot 130 is arranged to receive locking pin 114 to non-rotatably connect rotor 110 and locking cover 102. Slot 132 in side 128 is arranged to receive locking pin 122 to non-rotatably connect rotor 118 and locking cover 102.

Slot 130 is arranged to receive fluid to urge pin 114 in axial direction AD1 out of cover 102 such that rotor 110 is rotatable with respect to stator 108 and locking cover 102. Slot 132 is arranged to receive fluid to urge pin 122 in axial direction AD2 out of cover 102 such that rotor 118 is rotatable with respect to stator 116 and locking cover 102. Operation of pins 114 and 122 is further described below.

In an example embodiment, section 104 includes spring 134 and peg 136. Peg 136 is inserted into opening 138 of rotor 110. Spring 134 and pin 114 are placed over peg 136 with end 114A of pin 114 in contact with spring 134. Spring 134 reacts against head 136A of peg 136 to urge pin 114 in axial direction AD2 toward locking cover 102. In an example embodiment, section 106 includes spring 138 and peg 140. Peg 140 is inserted into rotor 118. Spring 138 and pin 122 are placed over peg 140 with end 122A of pin 122 in contact with spring 138. Spring 138 reacts against head 140A of peg 140 to urge pin 122 in axial direction AD1 toward locking cover 102.

In an example embodiment, locking cover 102 includes threaded bores 142 and 144 and threaded fasteners 146 and 148. Fasteners 146 pass through openings 150 and 152 in the drive sprocket and stator 108, respectively, and are threaded into bores 142 to non-rotatably connect the drive sprocket and stator 108 to locking cover 102. Fasteners 148 pass through openings 154 in stator 116 and are threaded into bores 144 to non-rotatably connect stator 116 to locking cover 102.

In an example embodiment, rotor 110 includes channels 156 connecting inner circumferential surface 158 of rotor 110 with chambers 112, and rotor 118 includes channels 160 connecting inner circumferential surface 161 of rotor 118 with chambers 120. Channels 156 are arranged to flow fluid in and out of chambers 112 to circumferentially locate rotor 110 with respect to stator 108. Channels 160 are arranged to flow fluid in and out of chambers 120 to circumferentially locate rotor 118 with respect to stator 116.

In an example embodiment, rotor 110 includes separate vanes 162 inserted into respective slots 164 in rotor 110, and rotor 118 includes separate vanes 166 inserted into slots 168 in rotor 118. Chambers 112 are partially formed by vanes 162, and chambers 120 are partially formed by vanes 166. It should be understood that rotors 110 and 118 also can be formed as respective one-piece components having respective integral vanes.

In an example embodiment, section 104 includes spring 170 and cover 172. Spring 170, in particular, tab 170A is engaged with rotor 110 to urge rotor 110 into a desired circumferential position when fluid pressure in chambers 112 falls below a predetermined level. In an example embodiment, section 106 includes side plate 174, spring 176, and cover 178. Fasteners 148 pass through openings 180 in the side plate to secure the side plate against stator 116 and rotor 118 to seal one axial side of chambers 120. Spring 176, in particular, tab 176A is engaged with rotor 118 to urge rotor 118 into a desired circumferential position when fluid pressure in chambers 120 falls below a predetermined level.

In an example embodiment, phaser 100 includes fluid feed 182. Channels 184 in fluid feed 182 are in fluid communication with channels 156 in rotor 110 and are used to provide fluid to chambers 112. Channels 186 in feed 182 are in fluid communication with channels 160 in rotor 118 and are used to provide fluid to chambers 120. Feed 182 also includes oil rings 188.

Displacement of pins 114 and 122 axially in and out of slots 130 and 132, respectively, creates increased wear on the portions of plate 102 in contact with pins 114 and 122. In an example embodiment, the portions of plate 102 in contact with pins 114 and 122 are hardened to compensate for the wear. In an example embodiment, phaser 100 includes hardened locking inserts 190A and 190B disposed in portions 130A and 132A of slots 130 and 132, respectively. Pins 114 and 122 contact inserts 190A and 190B, respectively, shielding the remaining portions of plate 102 from the increased wear noted above. Advantageously, the use of inserts 190A and 190B eliminates the need to hardening plate 102, simplifying operations and reducing costs associated with fabricating plate 102.

The following provides further detail regarding phaser 100. In an example embodiment, phase 104 is an exhaust phase, phase 106 is an intake phase, and phase 104 is assembled prior to assembling phase 106. As part of the assembly of phase 104, a locking clearance is set with locking pin 114 and return spring 170 is wound. In like manner, phase 106 is assembled onto plate 102. Thus, plate 102 functions as a dual-sided locking plate.

When fluid pressure in chambers 112 and 120 falls below a certain value, for example, when fluid is not supplied to the chambers, springs 170 and 176 rotate rotors 110 and 118, respectively, such that pins 114 and 122 are axially aligned with slots 130 and 132, respectively. Springs 134 and 138 urge pins 114 and 122 into slots 130 and 132, respectively, to rotationally lock rotors 110 and 118. When fluid is initially supplied to chambers 112 and 120, increasing the fluid pressure in the chambers, the rotational locking of rotors 110 and 118 prevents the undesirable oscillation and vibration noted above. When fluid pressure in chambers 112 increases to an operational level, the fluid pressure is great enough to overcome the force exerted by spring 134 in direction AD2 and displace pin 114 in direction AD1 such that pin 114 is displaced out of slot 130 and rotor 110 is rotatable with respect to plate 102 and stator 108. In like manner, when fluid pressure in chambers 120 increases to an operational level, the fluid pressure is great enough to overcome the force exerted by spring 138 in direction AD1 and displace pin 122 in direction AD2 such that pin 122 is displaced out of slot 132 and rotor 118 is rotatable with respect to plate 102 and stator 116.

Advantageously, phaser 100 enables the desired locking of rotors 110 and 118 during start up operations (raising fluid pressure in chambers 112 and 120, respectively) while minimizing axial length 192 of the phaser. For example, since one locking cover, rather than two locking covers, is used in phaser 100, length 192 is reduced at least by axial length 194 of locking cover 102.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A dual independent phaser, comprising:
one only single locking cover;
a first phaser section including:
a first stator;
a first rotor;
a first plurality of chambers formed by the first rotor and the first stator; and,
a first locking pin non-rotatably engaged with the first rotor and axially displaceable to non-rotatably connect the first rotor and the one only single locking cover; and,
a second phaser section including:
a second stator;
a second rotor;
a second plurality of chambers formed by the second rotor and the second stator; and,
a second locking pin non-rotatably engaged with the second rotor and axially displaceable to non-rotatably connect the second rotor and the one only single locking cover.

2. The dual independent phaser of claim 1, further comprising:
a drive sprocket non-rotatably connected to the first and second stators and arranged to receive torque from an engine, wherein:
the first plurality of chambers is arranged to circumferentially position, in response to fluid pressure in the first plurality of chambers, the first rotor with respect to the drive sprocket; and,
the second plurality of chambers is arranged to circumferentially position, in response to fluid pressure in the second plurality of chambers, the second rotor with respect to the drive sprocket.

3. The dual independent phaser of claim 1, wherein:
the first phaser section is disposed on a first axial side of the one only single locking cover; and,
the second phaser section is disposed on a second axial side, axially opposite the first axial side of the one only single locking cover.

4. The dual independent phaser of claim 1, wherein:
the one only single locking cover includes a first slot in a first axially-facing side of the one only single locking cover;
the first slot includes a first portion arranged to receive the first locking pin to non-rotatably connect the first rotor and the one only single locking cover;
the one only single locking cover includes a second slot in a second axially-facing side, axially opposite the first axially-facing side, of the one only single locking cover;
the second slot includes a second portion arranged to receive the second locking pin to non-rotatably connect the second rotor and the one only single locking cover.

5. The dual independent phaser of claim 4, wherein:
the first slot includes a third portion arranged to receive fluid to urge the first pin in a first axial direction away from the first slot such that the first rotor is rotatable with respect to the one only single locking cover; and,
the second slot includes a fourth portion arranged to receive fluid to urge the second pin in a second axial direction away from the second slot such that the second rotor is rotatable with respect to the one only single locking cover.

6. The dual independent phaser of claim 5, further comprising:

a first spring urging the first pin in the second axial direction toward the one only single locking cover; and, a second spring urging the second pin in the first axial direction toward the one only single locking cover.

7. The dual independent phaser of claim 1, wherein:

the one only single locking cover includes:

a first plurality of threaded bores in a first axially-facing side of the one only single locking cover; and, a second plurality of threaded bores in a second axially-facing side, axially opposite the first axially-facing side, of the one only single locking cover;

the first phaser section includes:

a drive sprocket arranged to receive torque from and engine; and, a first plurality of fasteners passing through the drive sprocket and the first stator and threaded into the first plurality of threaded bores to non-rotatably connect the drive sprocket and the first stator to the one only single locking cover; and, the second phaser section includes a second plurality of fasteners passing through the second stator and threaded into the second plurality of threaded bores to non-rotatably connect the second stator to the one only single locking cover.

8. The dual independent phaser of claim 1, wherein:

the first rotor includes a first plurality of channels connecting an inner circumferential surface of the first rotor with the first plurality of chambers; and, the second rotor includes a second plurality of channels connecting an inner circumferential surface of the second rotor with the second plurality of chambers.

9. The dual independent phaser of claim 8, wherein:

the first plurality of channels are arranged to flow fluid in and out of the first plurality of chambers to circumferentially located the first rotor with respect to the first stator; and, the second plurality of channels are arranged to flow fluid in and out of the second plurality of chambers to circumferentially locate the second rotor with respect to the second stator.

10. A dual independent phaser, comprising:

one only single locking cover;

a first phaser section disposed on a first axial side of the one only single locking cover and including:

a drive sprocket arranged to receive torque from an engine;

a first stator non-rotatably connected to the drive sprocket;

a first rotor;

a first plurality of chambers formed by the first rotor and the first stator; and, a first locking pin non-rotatably engaged with the first rotor and axially displaceable to non-rotatably connect the first rotor and the one only single locking cover;

a second phaser section disposed on a second axial side, axially opposite the first axial side of the one only single locking cover and including:

a second stator non-rotatably connected to the drive sprocket;

a second rotor;

a second plurality of chambers formed by the second rotor and the second stator; and, a second locking pin non-rotatably engaged with the second rotor and axially displaceable to non-rotatably connect the second rotor and the one only single locking cover; and, a drive sprocket non-rotatably connected to the first and second stators and arranged to receive torque from an engine, wherein:

the first plurality of chambers is arranged to circumferentially position, in response to fluid pressure in the first plurality of chambers, the first rotor with respect to the drive sprocket; and, the second plurality of chambers is arranged to circumferentially position, in response to fluid pressure in the second plurality of chambers, the second rotor with respect to the drive sprocket.

11. The dual independent phaser of claim 10, wherein:

the one only single locking cover includes a first slot in a first axially-facing side of the one only single locking cover;

the first slot includes a first portion arranged to receive the first locking pin to non-rotatably connected the first rotor and the one only single locking cover;

the one only single locking cover includes a second slot in a second axially-facing side, axially opposite the first axially-facing side, of the one only single locking cover;

the second slot includes a second portion arranged to receive the second locking pin to non-rotatably connected the second rotor and the one only single locking cover.

12. The dual independent phaser of claim 11, wherein:

the first slot includes a third portion arranged to receive fluid to urge the first pin in a first axial direction away from the first slot such that the first rotor is rotatable with respect to the one only single locking cover; and, the second slot includes a fourth portion arranged to receive fluid to urge the second pin in a second axial direction away from the second slot such that the second rotor is rotatable with respect to the one only single locking cover.

13. The dual independent phaser of claim 12, further comprising:

a first spring urging the first pin in the second axial direction toward the one only single locking cover; and, a second spring urging the second pin in the first axial direction toward the one only single locking cover.

14. The dual independent phaser of claim 10, wherein:

the one only single locking cover includes:

a first plurality of threaded bores in the first axially-facing side of the one only single locking cover; and, a second plurality of threaded bores in the second axially-facing side, axially opposite the first axially-facing side, of the one only single locking cover;

the first phaser section includes a first plurality of fasteners passing through the drive sprocket and the first stator and threaded into the first plurality of threaded bores to non-rotatably connect the drive sprocket and the first stator to the one only single locking cover; and, the second phaser section includes a second plurality of fasteners passing through the second stator and threaded into the second plurality of threaded bores to non-rotatably connect the second stator to the one only single locking cover.

15. The dual independent phaser of claim 10, wherein:

the first rotor includes a first plurality of channels connecting an outer circumferential surface of the first rotor with the first plurality of chambers; and, the second rotor includes a second plurality of channels connecting an outer circumferential surface of the second rotor with the second plurality of chambers.

16. The dual independent phaser of claim 15, wherein:

the first plurality of channels are arranged to flow fluid in and out of the first plurality of chambers to circumferentially located the first rotor with respect to the first stator; and, the second plurality of channels are arranged to flow fluid in and out of the second plurality of chambers to circumferentially locate the second rotor with respect to the second stator.

17. A method of fabricating a dual independent phaser, comprising:

non-rotatably connecting a drive sprocket and a first stator for a first phaser section to a first axial side of one only single locking cover;

forming a first plurality of chambers with the first stator and a first rotor;

non-rotatably engaging a first locking pin with the first rotor so that the first locking pin is axially displaceable to non-rotatably connect the first rotor to the one only single locking cover;

non-rotatably connecting a second stator for a second phaser section to a second axial side, axially opposite the first axial side, of the one only single locking cover;

forming a second plurality of chambers with the second stator and a second rotor;

non-rotatably engaging a second locking pin with the second rotor so that the second locking pin is axially displaceable to non-rotatably connect the second rotor to the one only single locking cover, wherein:

the first plurality of chambers is arranged to circumferentially position, in response to fluid pressure in the first plurality of chambers, the first rotor with respect to the drive sprocket; and, the second plurality of chambers is arranged to circumferentially position, in response to fluid pressure in the second plurality of chambers, the second rotor with respect to the drive sprocket.

18. The method of claim 17, further comprising:

engaging the first and second locking pins with first and second springs, respectively;

the first spring urges the first locking pin in a first axial direction into engagement with a first portion of a first slot in the first axially-facing side of the one only single locking cover to non-rotatably connect the first rotor and the one only single cover plate; and, the second spring urges the second locking pin in a second axial direction, opposite the first axial direction, into engagement with a second portion of a second slot in the second axially-facing side of the one only single locking cover to non-rotatably connect the second rotor and the one only single cover plate.

19. The method of claim 18, wherein:

the first slot includes a third portion arranged to receive fluid to urge the first pin in the second axial direction away from the first slot such that the first rotor is rotatable with respect to the one only single locking cover; and, the second slot includes a fourth portion arranged to receive fluid to urge the second pin in the first axial direction away from the second slot such that the second rotor is rotatable with respect to the one only single locking cover.

20. The method of claim 17, further comprising:

displacing a first plurality of threaded fasteners through the drive sprocket and the first stator;

threading the first plurality of threaded fasteners into a first plurality of threaded bores in the first axially-facing side of the one only single locking cover to non-rotatably connect the drive sprocket and first stator to the one only single cover plate;

displacing a second plurality of threaded fasteners through the second stator;

threading the second plurality of threaded fasteners into a second plurality of threaded bores in the second axially-facing side of the one only single locking cover to non-rotatably connect the second stator to the one only single cover plate.

* * * * *